US005575383A

United States Patent [19]

Seeley

[11] Patent Number: 5,575,383

[45] Date of Patent: Nov. 19, 1996

[54] CONTAINER HAVING AN AUDIBLE SIGNALING DEVICE

[76] Inventor: Dennis H. Seeley, 7 N. Delaware Avenue, Pier 5, Unit 105, Philadelphia, Pa. 19106

[21] Appl. No.: 437,789

[22] Filed: May 9, 1995

Related U.S. Application Data

[63] Continuation of Ser. No. 254,614, Jun. 6, 1994, Pat. No. 5,464,092.

[51] Int. Cl.[6] ..... B65D 85/72; G09F 25/00

[52] U.S. Cl. ..... 206/217; 206/459.1; 340/384.7

[58] Field of Search ..... 206/217, 232, 206/459.1, 459.5, 831; 340/384.7

[56] References Cited

U.S. PATENT DOCUMENTS

| | | | |
|---|---|---|---|
| 3,798,806 | 3/1974 | Sanford | 40/28.1 |
| 4,398,491 | 8/1983 | Fridl et al. | 220/231 |
| 4,607,747 | 8/1986 | Steiner | 206/459.1 |
| 4,688,023 | 8/1987 | McGill et al. | 206/459.1 |
| 4,756,222 | 7/1988 | Armato | 84/1.01 |
| 4,845,470 | 7/1989 | Boldt, Jr. . | |
| 4,847,597 | 7/1989 | Dobosi et al. | 206/459.1 |
| 4,866,865 | 9/1989 | Yang | 40/455 |
| 5,056,659 | 10/1991 | Howes et al. | 203/217 |
| 5,063,698 | 11/1991 | Johnson et al. | 40/124.1 |
| 5,099,232 | 3/1992 | Howes | 206/217 |
| 5,245,171 | 9/1993 | Fox et al. | 235/492 |
| 5,275,285 | 1/1994 | Clegy | 206/449 |

FOREIGN PATENT DOCUMENTS

| | | |
|---|---|---|
| 0233077 | 8/1987 | European Pat. Off. . |
| 2265142 | 9/1993 | United Kingdom . |

*Primary Examiner*—Jimmy G. Foster
*Attorney, Agent, or Firm*—Volpe and Koenig, P.C.

[57] ABSTRACT

An audible signaling device mounted on a product container is actuated by the opening of the container. The signaling device comprises a power source, a memory for storing data corresponding to audible tones, an electronic sound generator for accessing the memory and generating audible tones, and a switch for connecting the electronic sound generator to the power source. The switch is responsive to the opening of the container whereupon audible tones are produced.

9 Claims, 8 Drawing Sheets

FIG. 6
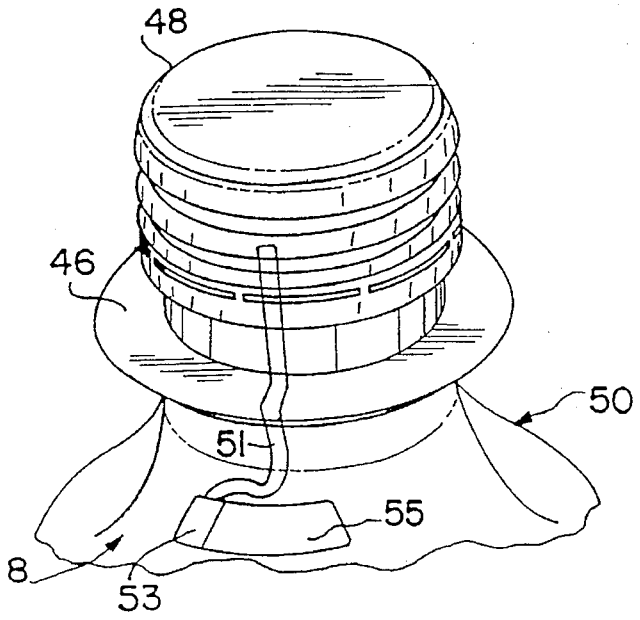
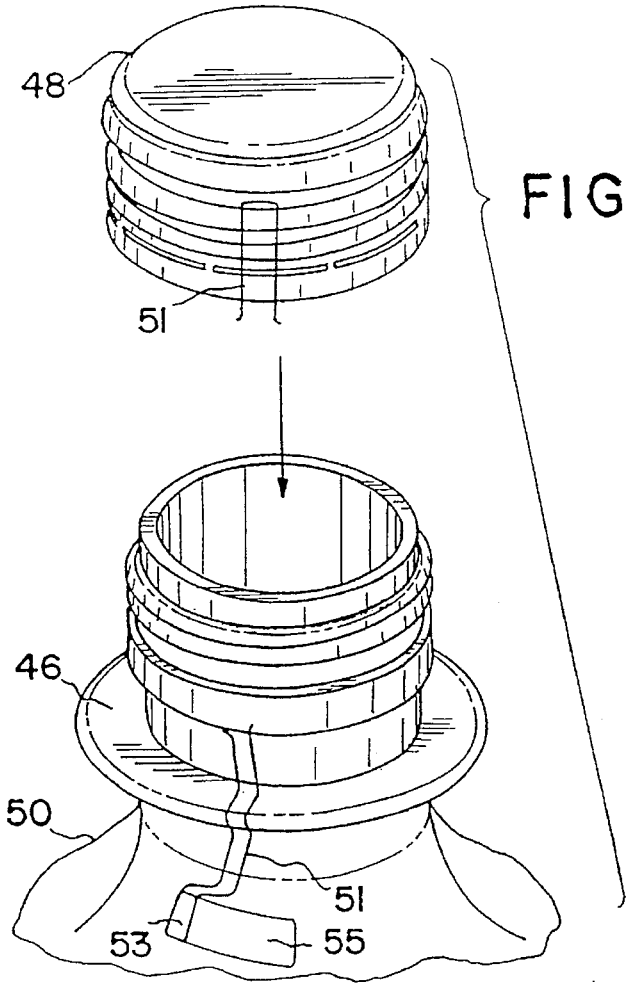
FIG. 7

FIG. 16
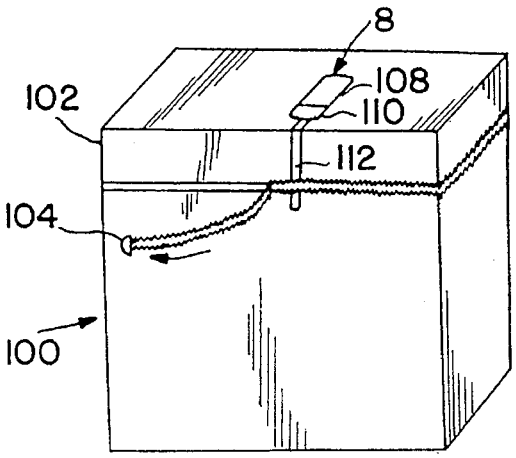
FIG. 17
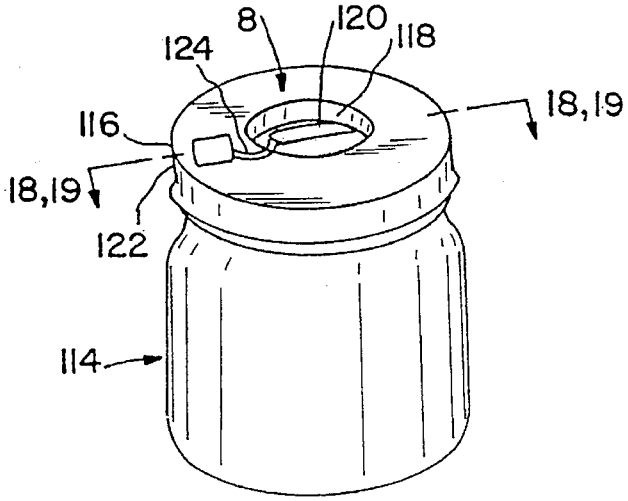
FIG. 18
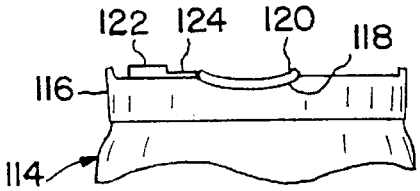
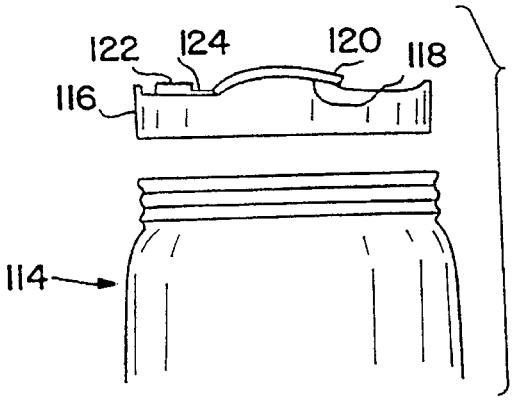
FIG. 19

CONTAINER HAVING AN AUDIBLE SIGNALING DEVICE

This is a continuation of application Ser. No. 08/254,614, filed on Jun. 6, 1994, U.S. Pat. No. 5,464,092.

BACKGROUND OF THE INVENTION

This invention relates generally to devices which detect the opening of a container. More particularly, the invention relates to sealed containers having a signaling device which generates an audible message when the container is opened.

1. Field of the Invention

Manufacturers of consumer goods have long understood the importance of packaging to the success of a product in the marketplace. In an increasingly competitive marketplace, distinctive packaging can provide a manufacturer with a competitive advantage to increase sales and market share.

When the marketplace contains many brands of goods which are the same or of similar quality, product packaging may be as important as product quality in distinguishing the goods of one manufacturer over another. Among the many factors which must be considered when designing a product package are: package appearance; convenience of opening and resealing; tamper resistance; and promotional effectiveness.

Product promotional programs may include alteration of the package for a limited duration, or a prize notification in the package with the product. For liquid, semi-liquid and/or moist products, practical promotional options available are limited. For such products, the risk of contaminating the product by the insertion of a prize or prize notice into the package is much higher than for dry goods. Accordingly, manufacturers of food products such as soda, beer, juice, jellies, jams and dips have avoided these promotional programs.

In addition to the promotional value, manufacturers are constantly searching for means to ensure their products are safe for the consuming public.

2. Description of Related Art

It is known in the art to use liquid or moist product containers as a vessel for holding a prize award, for example see U.S. Pat. No. 5,056,659 (Howes et al.). However, these containers are only for promotional purposes and do not contain the actual product. Although a consumer receives a prize, the consumer does not receive the desired product. Accordingly, these containers do not need to address contamination concerns raised when providing a prize notification with the product. Further, many known promotional containers require substantial alterations in existing container designs and technology, thereby resulting in considerable increases in promotional costs.

It is also known in the art to provide packages for gift merchandise including a battery-powered signal generator, such as that disclosed in U.S. Pat. No. 4,607,747 (Steiner); and to utilize a signal generator for a musical greeting card such as that disclosed in U.S. Pat. No. 3,798,806 (Sanford). Although these references disclose the use of a signal generator, they do not disclose a tone generating module that may be utilized on an existing container design.

SUMMARY OF THE INVENTION

The present invention provides an audible signaling device mounted on a product container. The signaling device includes a switch which is responsive to the opening of a container. The switch activates a tone generating module which emits a desired audible message or other sounds. The message may be promotional in nature, may contain an audible warning, or may provide useful product information.

The preferred embodiment includes an integrated circuit (IC) switch which is responsive to an open-circuit. The switch is mounted so that when the container is opened or unsealed, the conductor associated with the IC switch is severed to create an open-circuit. The IC switch senses the open-circuit, changes states and activates the tone generating module.

Another embodiment includes a deflection switch which is surface-mounted on a pressurized container, such as a sealed beverage can. The deflection switch is responsive to the change in the container profile which occurs when the seal is broken. Upon opening the container, the pressure within the container decreases and changes the container profile. The change in container profile changes the state of the deflection switch, thereby activating the tone generating module.

In yet another embodiment, a switch is surface-mounted to the top of a container which utilizes a pull-tab assembly, such as a beverage can. The switch actuator is connected to the tab assembly. When the tab assembly on the can is moved to open the can, the tab assembly engages the actuator, closes the contacts of the switch and activates the tone generating module.

It is an object of this invention to provide an effective means for promoting consumer products, especially liquid or moist products, without substantially changing the current package and container designs.

Another object of the present invention is to provide an effective means for indicating product tampering.

Still another object of the invention is to provide an effective means for indicating the expiration date of a consumable product.

BRIEF DESCRIPTION OF THE DRAWINGS

FIG. 6 is a perspective view of a second alternate embodiment of the present invention comprising a pressurized plastic soda bottle having a signalling device mounted thereon.

FIG. 7 is a perspective view of the plastic bottle of FIG. 7 after opening.

FIG. 16 is a perspective view of the cardboard box of FIG. 15 during opening.

FIG. 17 is a perspective view of a seventh alternate embodiment of the present invention comprising a vacuum-sealed jar having a signalling device mounted thereon.

FIG. 18 is a cross-sectional side elevational view of the jar shown in FIG. 17.

FIG. 19 is a cross-sectional side elevational view of the jar shown in FIG. 17 after it has been opened.

DESCRIPTION OF THE PREFERRED EMBODIMENT

Figure 1:
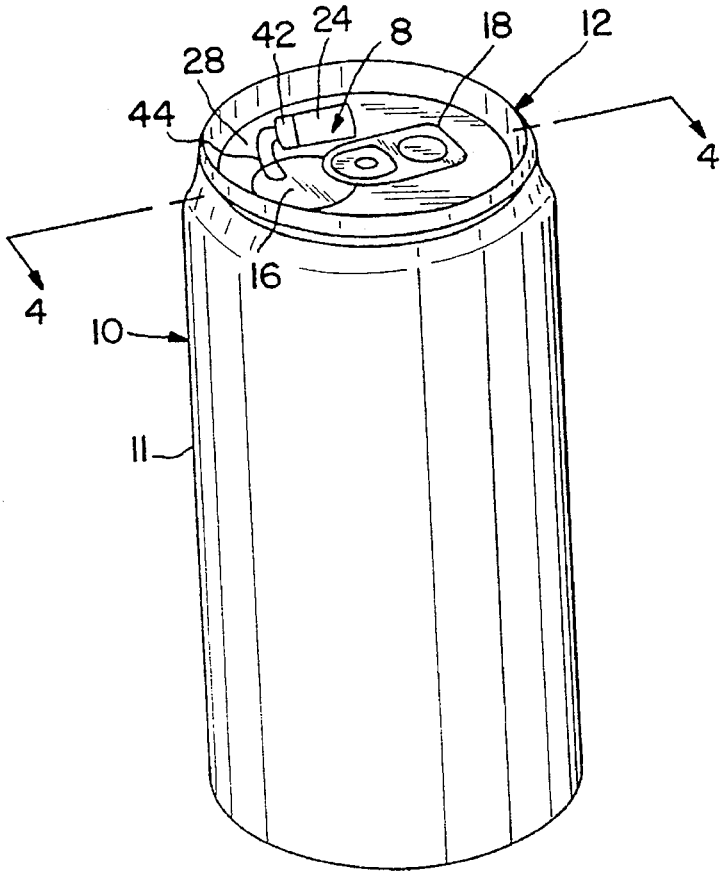
FIG. 1 is a perspective view of a pressurized beverage can having a signalling device made in accordance with the teaching of the present invention.
Figure 2:
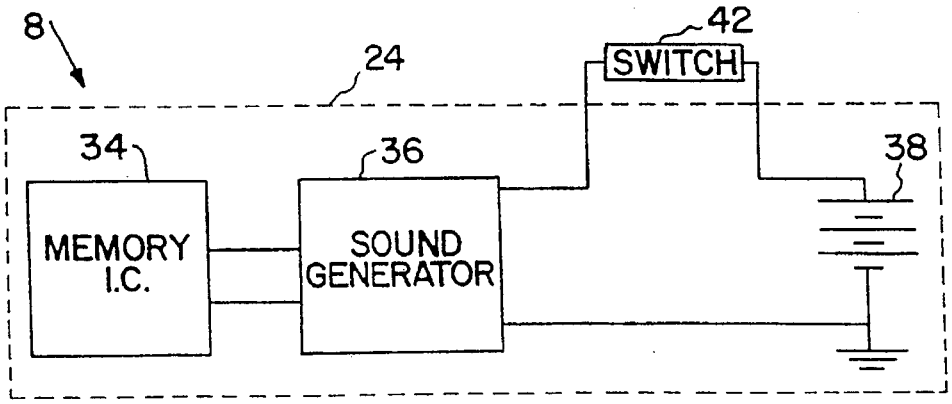
FIG. 2 is a block diagram of the circuitry of the signalling device of FIG. 1.

Referring to FIGS. 1 through 5, a signalling device 8 is mounted on a pressurized beverage can 10. The can 10 has a cylindrical lower container portion 11 and a rim 12 to which a lid 28 is compressively attached. The lid 28 includes a tab assembly 18 and a pre-cut tab 16. The tab 16 seals an access opening 17. The signalling device 8 comprises a tone generating module 24, an electronic switch 42, and a sensor conductor 44. As shown in FIG. 2, the tone generating module 24 comprises a memory integrated circuit (IC) 34, a sound generator 36 and an energy source 38. The memory IC 34 stores the data which is processed by the sound generator 36 to produce an audible tone or synthesized speech. The memory 34 in the preferred embodiment consists of a read only memory (ROM) which has been pre-programmed for the specific message and/or sound to be generated.

The specific data stored in the ROM depends upon the message that the manufacturer of the product wishes to convey to the consumer. The message can contain musical tones in combination with the synthesized speech, such as a manufacturer's jingle. The generated message can be promotional or informational in nature, such as by stating a preferred recipe for the product, such as "Be sure to mix two-thirds cola with one-third rum". Alternatively, the message can indicate that the consumer has won a specified award such as, "Congratulations, you have won $500". To prevent forgery of an award by the recipient, the manufacturer may require the consumer to detach and return the tone generating module 24 to the manufacturer for award verification. The ROM 34 may then be accessed by the manufacturer to verify that the consumer is the recipient of an authentic winning tone generating module 24, and therefore is entitled to an award.

The message can also provide product safety information indicating product tampering or spoilage. For example, messages such as "Do not use this product if it is after Nov. 1, 1994", or "This product is fresh through Nov. 1, 1994" could be used with a product that is perishable. Further, the message can state "This product has not been opened", to indicate that it is unlikely the product has been tampered with.

The noise created when opening a package, for example the sound of the "hiss" of a pressurized soda can, may partially obscure the synthesized speech message. In order to ensure that the message is clearly heard, the tone generating module 24 preferably includes means to delay the message for a predetermined duration. In the preferred embodiment, a predetermined period of silence is included at the beginning of the message stored in memory 34. Alternatively, the sound generator 36 may include an electronic timer which is activated when the electronic switch 42 closes. The timer "times out" after a predetermined duration and activates the sound generator 36.

The switch 42 is electrically connected between the power source or battery 38 and the sound generator 36 of module 24 to activate or deactivate the tone generating module 24. Different switches, as shown in the alternate embodiments, may be utilized depending upon the specific application or container.

Figure 3:
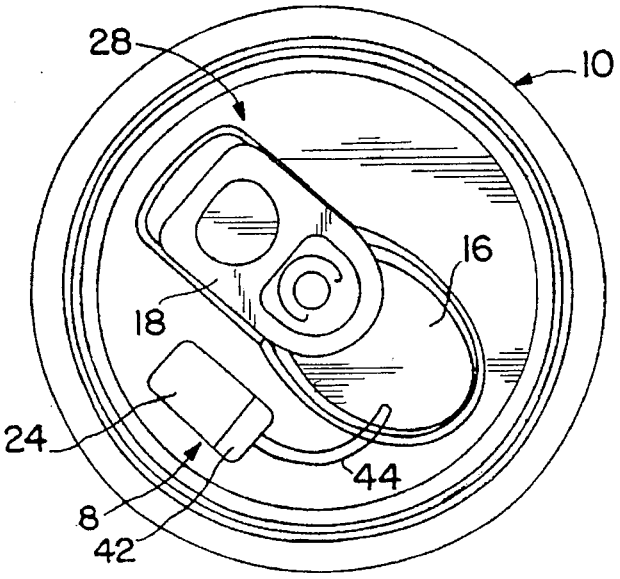
FIG. 3 is a top view of the beverage can shown in FIG. 1.

As best seen in FIG. 3, the sensor conductor 44 runs along the surface of the lid 28, across the tab 16 and back along the surface of the lid 28 to the electronic switch 42. In the preferred embodiment, the sensor conductor 44 is a thin-film conductor which is electrically isolated from the surface of the lid 28.

Figure 4:
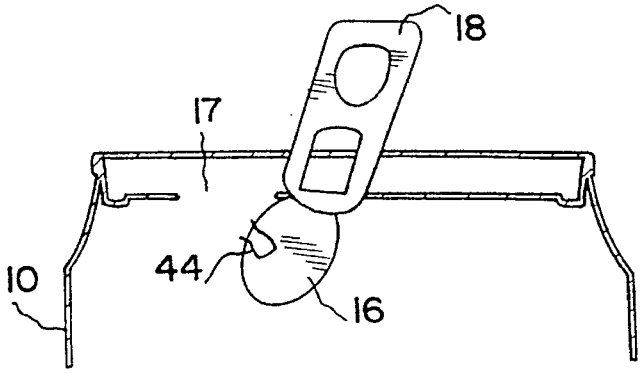
FIG. 4 is a cross-sectional side elevational view of the beverage container shown in FIG. 1 after it has been opened.

Operation of the signalling device 8 is controlled by the switch 42 activating the tone generating module 24. The sensor conductor 44 provides a continuous (or closed) circuit which is monitored by the electronic switch 42. As long as the tab 16 sealingly engages the lid opening 17, the closed-circuit is maintained. As shown in FIG. 4, when the tab assembly 18 is moved, forcing the tab 16 to become substantially detached from the lid 28, a portion of the sensor conductor 44 becomes detached and an open-circuit is created. The electronic switch 42 senses the open-circuit and changes state to the closed position to activate the sound generator 36. When activated, the sound generator 36 accesses the data stored in the ROM 34, and generates a predetermined speech message and/or sound.

Figure 5:
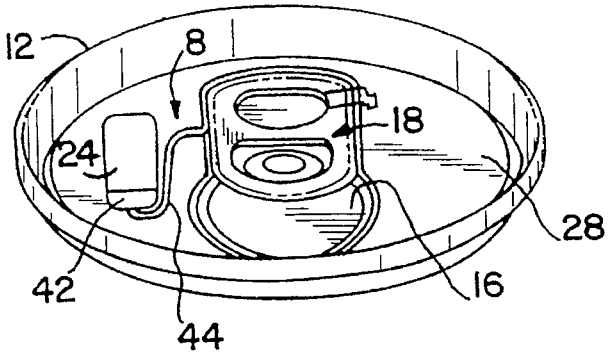
FIG. 5 is a perspective view of an alternate embodiment of the invention.

An alternate location for the sensor conductor 44 is shown in FIG. 5 wherein the sensor conductor 44 is displaced across the tab assembly 18.

The state of the electronic switch 42 depends upon the presence or absence of an open-circuit. Therefore, different embodiments may be developed utilizing a variety of beverage, food and drug containers, whether pressurized or unpressurized, as shown in FIGS. 6–9.

Referring to FIG. 6, a second alternate embodiment is shown comprising a pressurized plastic soda bottle 50 having a signalling device 8 mounted thereon. The sensor conductor 51 runs from the electronic switch 53, along the neck 46 of the sealed bottle 50, and across the bottle cap 48. When the bottle cap 48 is twisted to break the seal to open the bottle 50 as shown in FIG. 7, the sensor conductor 51 is severed, creating an open-circuit. The electronic switch 53 detects the open-circuit and activates the tone generating module 55.

Figure 8:
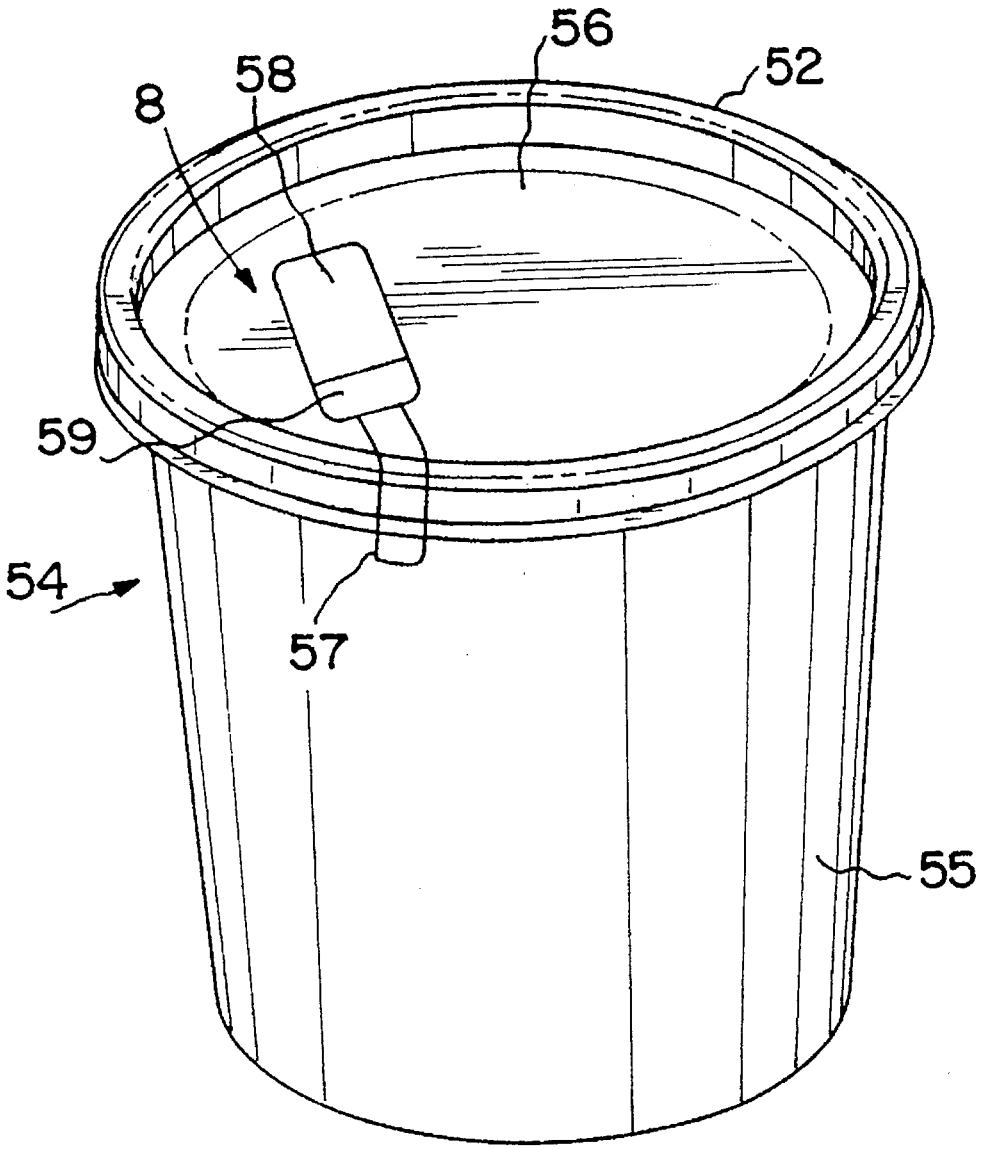
FIG. 8 is a perspective view of a third alternate embodiment of the present invention comprising an unpressurized container having a signalling device mounted thereon.
Figure 9:
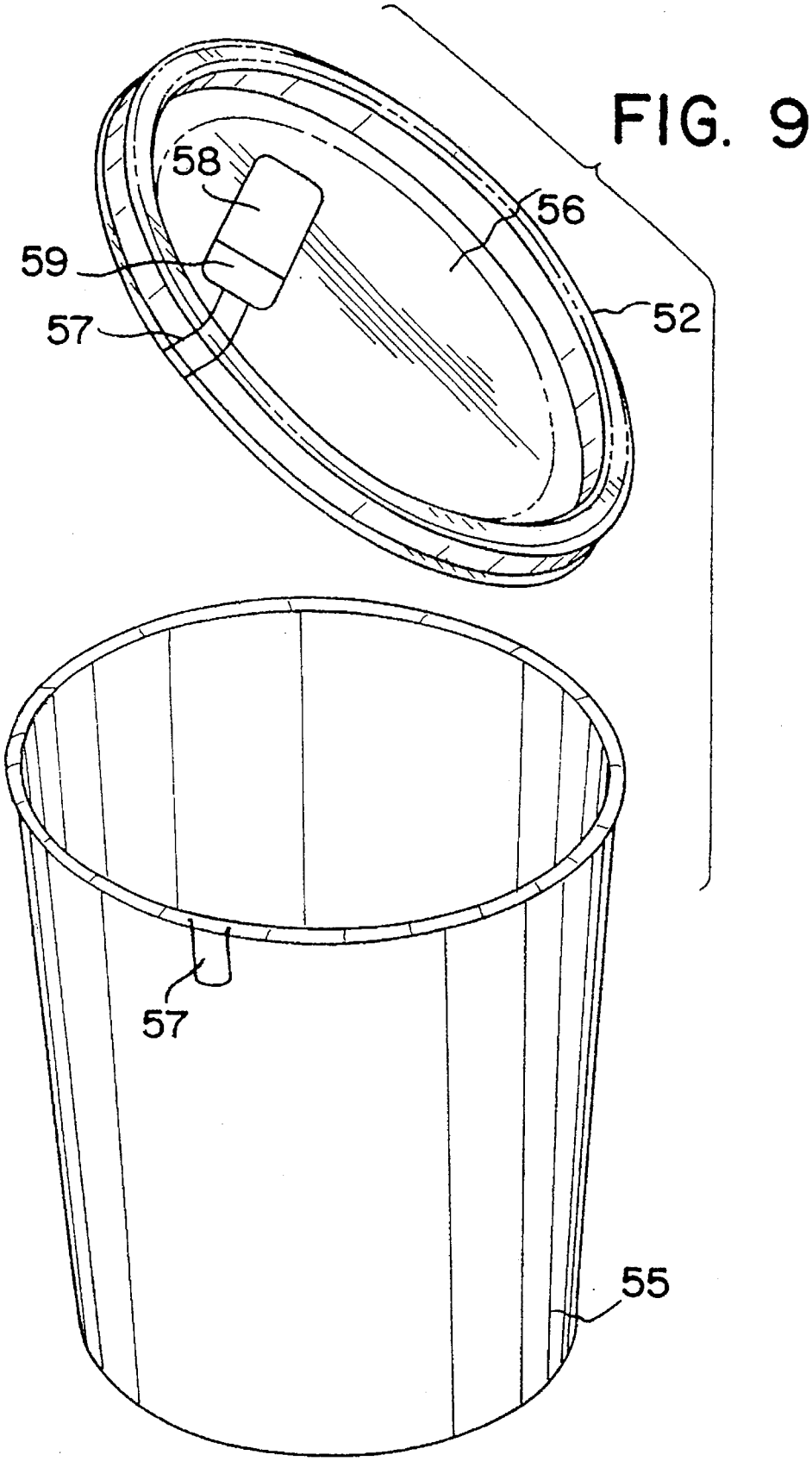
FIG. 9 is a perspective view of the container of FIG. 8 after opening.

Referring to FIG. 8, a third alternate embodiment is shown comprising an unpressurized moist product container 54, such as a yogurt container, having a signalling device 8 mounted thereon. The sensor conductor 57 emanates from the electronic switch 59, runs across the lid 56 over the lip 52, and onto the body 55 of the container 54. As the lid 56 is bent back for removal from the body 55 to open the container 54 as shown in FIG. 9, the sensor conductor 57 is severed between the lip 52 and the body 55, creating an open-circuit. The electronic switch 59 detects the open-circuit and activates the tone generating module 58.

Figure 10:
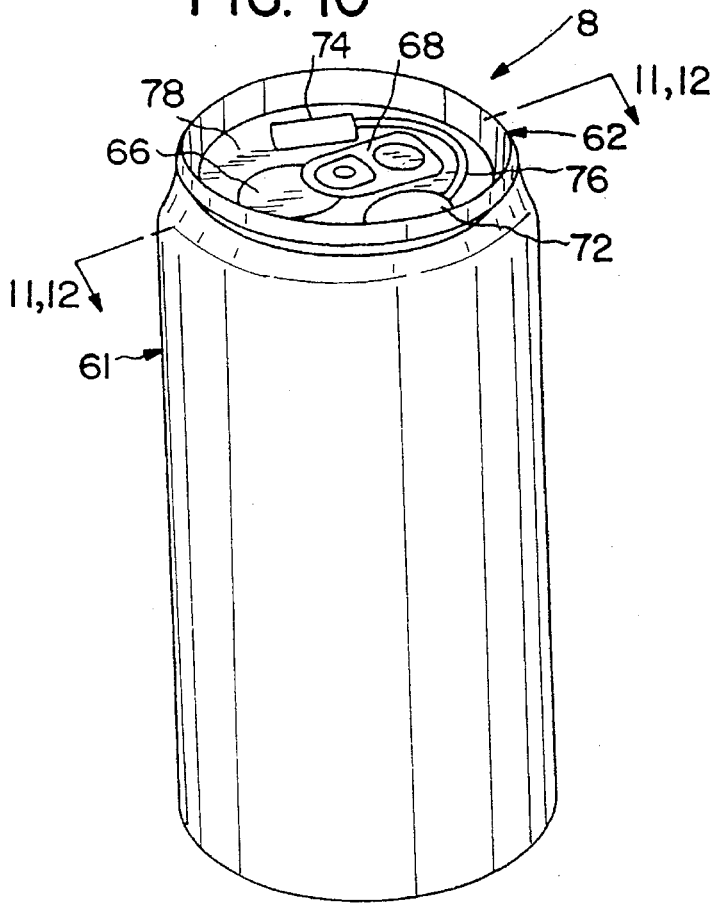
FIG. 10 is a perspective view of a fourth alternate embodiment of a pressurized beverage can having a signalling device made in accordance with the teachings of the present invention.

Operation of a fourth alternate embodiment can be explained with reference to FIG. 10. The fourth alternate embodiment comprises a pressurized beverage can 61 having a signalling device 8 mounted thereon. The can 61 has a lid 78 with a tab assembly 68 which includes a tab 66 which sealingly engages the lid 78. The tone generating module 74 is connected to a deflection switch 72 via a sensor conductor 66 which is electrically isolated from the lid 78. The deflection switch 72 is surface-mounted on the lid 78, substantially approximating the lid profile.

Figure 11:
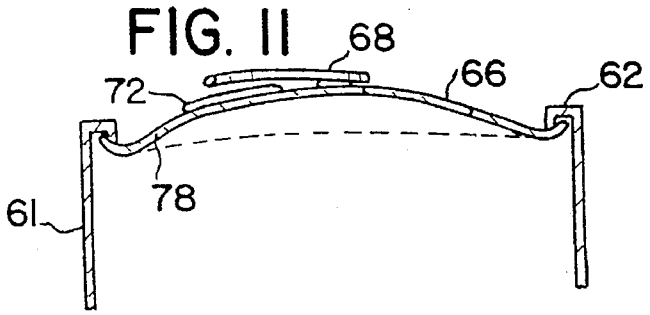
FIG. 11 is a cross-sectional side elevational view of the beverage can shown in FIG. 10.
Figure 12:
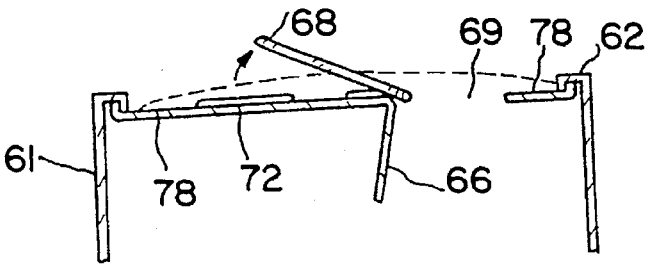
FIG. 12 is a cross-sectional side elevational view of the beverage can shown in FIG. 10 after it has been opened.

As shown in FIG. 11, the pressure within the beverage can 61 forces the lid profile to be substantially convex, which has been exaggerated for illustrational purposes. A typical aluminum beverage can is pressurized to 38 lbs per square inch (PSI) at 60° F., 50 PSI at 75° F., and 63 PSI at 90° F. When the tab assembly 68 is moved, as shown in FIG. 12, it forces a substantial portion of the tab 66 to become detached from the lid 78, thereby breaking the seal and permitting the $CO_2$ gas within the can 61 to escape. As the pressure within the can 61 reaches ambient atmospheric pressure, the lid profile becomes substantially flat as shown in FIG. 12. The change in the profile of the deflection switch 72 causes the deflection switch 72 to change to the closed state, thus activating the tone generating module 74.

Figure 13:
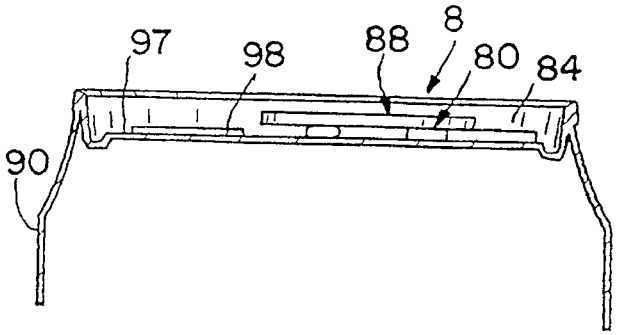
FIG. 13 is a cross-sectional side elevational view of a fifth alternate embodiment of the present invention comprising a pressurized beverage container having a signalling device mounted thereon.
Figure 14:
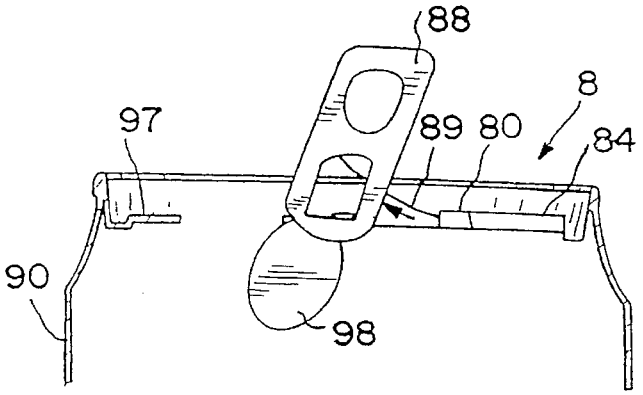
FIG. 14 is a cross-sectional side elevational view of the container of FIG. 13 after opening.

Operation of a fifth alternate embodiment can be explained with reference to FIG. 13. The fifth alternate embodiment comprises a pressurized beverage can 90 having a signalling device 8 mounted thereon. The can 90 has a lid 97 with a tab assembly 88 which includes a tab 98 which sealingly engages the lid 97. The tone generating module 84 is connected to a slide switch 80. The slide switch actuator 89 is connected to the tab assembly 88. As the tab assembly 88 is moved to open the can 90 as shown in FIG. 14, the tab assembly 88 pulls the actuator 89 and slidably engages the contacts of the slide switch 80. Accordingly, the state of the slide switch 80 is changed to the closed position, activating the tone generating module 84.

Alternatively, in this embodiment, the slide switch 80 may comprise a single contact separated from the battery 38 by the actuator 89, which comprises a thin electrically insulating element. As the tab assembly 88 is moved to open the can 90, the tab assembly 88 pulls the actuator 89 from between the contact and the battery 38, thus establishing a closed-circuit to power the tone generating module 84.

Figure 15:
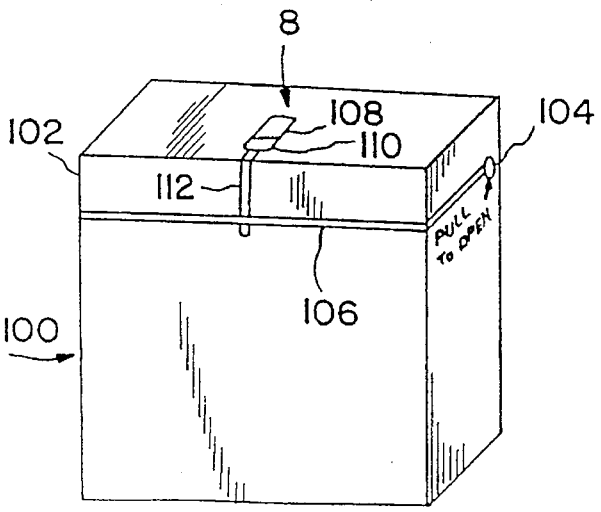
FIG. 15 is a perspective view of a sixth alternate embodiment of the present invention comprising a cardboard box having a signalling device mounted thereon.

Operation of a sixth alternate embodiment can be explained with reference to FIG. 15. The sixth alternate embodiment comprises a cardboard box 100 having a signalling device 8 mounted thereon. The box 100 has a top 102 with a tear tab assembly 104 and a perforation 106 where the top 102 sealingly engages the box 100. The tone generating module 108 is connected to an electronic switch 110. A sensor conductor 112 emanates from the electronic switch 110, runs across the top 102 and onto the box 100. As the tear tab assembly 104 is torn across the perforation 106 to disengage the top 102 from the box 100 as shown in FIG. 16, the sensor conductor 112 is severed, thereby creating an open-circuit. The electronic switch 110 detects the open-circuit and activates the tone generating module 108.

Operation of a seventh alternate embodiment can be explained with reference to FIG. 17. The seventh alternate embodiment comprises a vacuum-sealed jar 114, such as a baby food jar, having a signalling device 8 mounted thereon. The jar 114 has a lid 116 which rotatably engages the jar 114. The tone generating module 122 is connected to a deflection switch 120 via a sensor conductor 124 which is electrically isolated from the lid 116. The lid 116 includes a depression 118 which is substantially concave while the vacuum within the container is maintained, as shown in FIG. 18. The deflection switch 120 is surface-mounted on the lid 116, substantially approximating the profile of the depression 118.

When the lid 116 is twisted to open the jar 114, the jar 114 interior returns to ambient atmospheric pressure and the depression 118 profile becomes substantially convex as shown in FIG. 19. The change in the deflection switch 120 profile causes the deflection switch 120 to change to the closed state, thus activating the tone generating module 122.

Although the preferred and alternate embodiments of the present invention have been disclosed in detail above, a number of variations and modifications thereto will be readily apparent to one with ordinary skill in the art. For example, the foregoing description of the switches which detect the opening of the package have been provided for illustration purposes as there are other techniques and equipment known in the art. It is intended that these modifications and variations may be effected without departing from the scope of the novel concepts and teachings of the present invention.

We claim:

1. An audible tone generator externally mounted on a product container, the container comprising a compartment having an opening and a sealing member for sealing the compartment opening; said tone generator actuated by displacement of said sealing member relative to said compartment; the tone generator comprising:

a power source;

memory means for storing data corresponding to audible tones;

an electronic sound generator for accessing the memory means and generating audible tones; and switch means having a first portion located on said compartment and a second portion located on said sealing member; said switch means being responsive to the separation of said first portion from said second portion upon the displacement of said sealing member relative to said compartment; whereby said switch means connects said electronic sound generator to said power source to produce the audible tones.

2. The tone generating module of claim 1 wherein said memory means further includes data corresponding to silence for a predetermined duration for delaying the generation of audible tones.

3. The tone generating module of claim 2 wherein said switch means is responsive to the absence of electrical continuity in said first and second portions.

4. The tone generating module of claim 1 wherein said sealing member comprises a tab assembly and a pre-cut tab.

5. The tone generating module of claim 1 wherein said sealing member comprises a cap, twistably mounted to said compartment.

6. A signal generator externally mounted on a pressurized beverage container, the container having a lid which includes a tab assembly and a pre-cut tab which is substantially detached from the lid to open the container, the signal generator comprising:

a power source comprising a battery;

an electronic storage means comprising a read-only memory (ROM) for storing data corresponding to audible tones;

an electronic sound generator connected to said electronic storage means for accessing said storage means and generating audible tones; and a switch means for connecting said electronic sound generator to said power source; said switch means comprising an electronic circuit which monitors the electrical continuity of a circuit having a first portion located on said pre-cut tab and a second portion located on said lid; wherein said switch means changes state in response to an electrical discontinuity caused by the separation of said first and second portions upon the substantial detachment of said pre-cut tab.

7. The container of claim 6 wherein said electronic storage means further includes data corresponding to silence for a predetermined duration for delaying the generation of said audible tones.

8. A method for providing a container having a compartment for receiving a product and an operative portal for accessing the product, comprising:

providing a signal generator which includes:

a power source;

memory means for storing data corresponding to audible tones;

an electronic sound generator for accessing the memory means and generating audible tones; and switch means responsive to the opening of said portal for connecting said electronic sound generator to said power source, whereupon the audible tones are produced, said switch means including a circuit having a first portion located on said compartment and a second portion located on said portal; and mounting said signal generator on said container external to said compartment; whereby opening the portal to access the product detaches said first circuit portion from said second circuit portion to activate the signal generator.

9. An audible tone generator externally mounted on a pressurized product container, the container comprising a compartment having an opening and a sealing member for sealing the compartment opening; the sealing member having two configurations, a first configuration being substantially curved when the container is pressurized, and a second configuration being substantially flat when the container is depressurized; the tone generator comprising:

a power source;

memory means for storing data corresponding to audible tones;

an electronic sound generator for accessing the memory means and generating audible tones; and switch means being responsive to the change in the configuration of said sealing member to connect said electronic sound generator to said power source to produce the audible tones when said container is depressurized.

* * * * *